US007192129B2

(12) United States Patent
Droege et al.

(10) Patent No.: US 7,192,129 B2
(45) Date of Patent: Mar. 20, 2007

(54) BRIDGING WICK AND METHOD FOR AN INKJET PRINTHEAD

(75) Inventors: Curtis R. Droege, Richmond, KY (US); Bruce Gibson, Lexington, KY (US); Sam Norasak, Lexington, KY (US); Ann M. Trebolo, Nicholasville, KY (US); Kent L. Ubellacker, Georgetown, KY (US); Frank E. Anderson, Sadieville, KY (US); Adam N. Chalin, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 309 days.

(21) Appl. No.: 11/018,025

(22) Filed: Dec. 20, 2004

(65) Prior Publication Data

US 2006/0132553 A1 Jun. 22, 2006

(51) Int. Cl.
*B41J 2/175* (2006.01)

(52) U.S. Cl. ..... 347/87

(58) Field of Classification Search ..... 347/49, 347/85, 86, 87
See application file for complete search history.

(56) References Cited

U.S. PATENT DOCUMENTS

| | | | | |
|---|---|---|---|---|
| 5,453,771 | A * | 9/1995 | Waseda et al. | 347/86 |
| 5,552,816 | A * | 9/1996 | Oda et al. | 347/86 |
| 5,621,446 | A * | 4/1997 | Tanaka et al. | 347/85 |
| 5,760,806 | A * | 6/1998 | Oda et al. | 347/87 |
| 6,033,063 | A * | 3/2000 | Tomikawa et al. | 347/87 |
| 6,325,500 | B1 * | 12/2001 | Kitabatake et al. | 347/86 |
| 6,540,342 | B2 * | 4/2003 | Koshikawa et al. | 347/86 |

* cited by examiner

*Primary Examiner*—Anh T. N. Vo
(74) *Attorney, Agent, or Firm*—Michael Best & Friedrich

(57) ABSTRACT

Some embodiments of the present invention provide an inkjet printhead within which a removable ink cartridge can be installed. Upon installation, the ink cartridge can be coupled to one or more wicks in the printhead for establishing fluid communication between one or more chambers in the ink cartridge and nozzles through which ink exits the printhead during operation. The wick can extend from a cartridge receptacle to a substantially enclosed ink reservoir in order to transport ink from the removable cartridge to the ink reservoir.

46 Claims, 3 Drawing Sheets

BRIDGING WICK AND METHOD FOR AN INKJET PRINTHEAD

This application is filed concurrently with a corresponding and co-owned U.S. Patent Application entitled "Wick for an Inkjet Printhead".

BACKGROUND OF THE INVENTION

Conventional inkjet printers typically include one or more printheads in which ink is stored. Such printheads have one or more ink reservoirs in fluid communication with a nozzle plate through which ink is dispensed onto a print medium. In some cases, the printhead is adapted to be refilled with ink, such as by an ink-carrying cartridge that can be installed in the printhead and that can be replaced with another ink-carrying cartridge as needed.

In printheads having a removable and replaceable ink cartridge, an outlet of the cartridge is typically connected to a port or other structure of the printhead when the cartridge is installed within the printhead. This connection establishes fluid communication between a reservoir of ink within the cartridge and a fluid line of the printhead extending to the nozzle plate. To insure proper operation of the printhead, the interface between the cartridge outlet and the printhead should provide an uninterrupted path for ink moving from the cartridge toward the nozzle plate. The path can be interrupted, for example, by bubbles or when the cartridge outlet-to-printhead interface is allowed to dry out. In both cases, the printhead can lose prime, thereby stopping ink flow and causing printhead failure.

A clear and uninterrupted fluid path from a removable and replaceable ink cartridge to a printhead nozzle promotes proper operation of the printhead. Inkjet printheads are typically designed with this goal in mind, employing conventional materials and fluid flow features promoting free ink movement from the cartridge to the nozzle plate.

SUMMARY OF THE INVENTION

In some embodiments of the present invention, a printhead adapted to receive a removable ink cartridge is provided, and comprises a receptacle dimensioned to receive the removable ink cartridge; a reservoir separated from the receptacle by a barrier; an ink retaining medium in the reservoir; and a wick extending from the receptacle to the reservoir, wherein the wick is positioned to be operatively coupled to the removable ink cartridge when the removable ink cartridge is installed in the receptacle, and is operatively coupled to the ink retaining medium in the reservoir.

Some embodiments of the present invention provide a printhead for printing with ink from a removable ink cartridge having an outlet, wherein the printhead comprises a housing having a plurality of walls; first and second chambers at least partially defined by the plurality of walls and separated by a first wall of the plurality of walls; an ink retaining medium in the second chamber; a nozzle plate coupled to the housing, having at least one nozzle through which ink exits the printhead, and supplied by ink from the ink retaining medium; and a wick extending from the first chamber, past the first wall, and into the second chamber, the wick adapted to carry ink via capillary action from the outlet of the removable ink cartridge in the first chamber to the ink retaining medium in the second chamber.

In some embodiments of the present invention, a printhead is provided, and comprises a housing; a nozzle through which ink exits the printhead; a first chamber in the housing; a second chamber in the housing and separated from the first chamber by a wall; a removable ink cartridge in the first chamber, the removable ink cartridge having an outlet through which ink exits the removable ink cartridge; an ink retaining medium in the second chamber, the ink retaining medium located in a path of ink flow from the first chamber to the nozzle; and a wick having a first portion in capillary fluid communication with the outlet of the removable ink cartridge; and a second portion in capillary fluid communication with the ink retaining medium in the second chamber; wherein the ink retaining medium is supplied with ink from the removable ink cartridge via the wick.

A more complete understanding of the present invention, together with the organization and manner of operation thereof, will become apparent from the following detailed description of exemplary embodiments of the invention when taken in conjunction with the accompanying drawings, wherein like elements have like numerals throughout the drawings.

Figure 1:
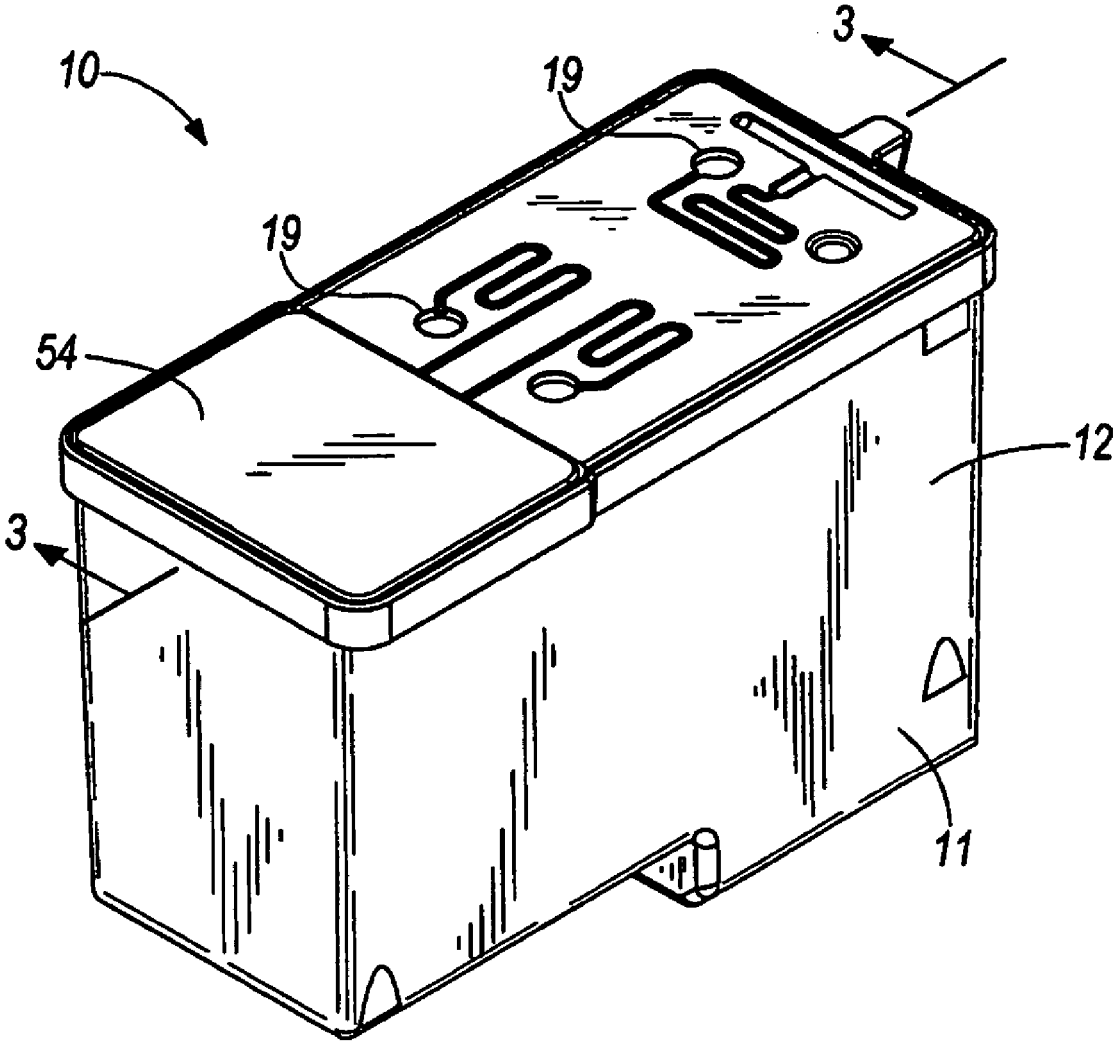
FIG. 1 is a perspective view of a printhead according to an embodiment of the present invention.

Before the various exemplary embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

DETAILED DESCRIPTION

Figure 2:
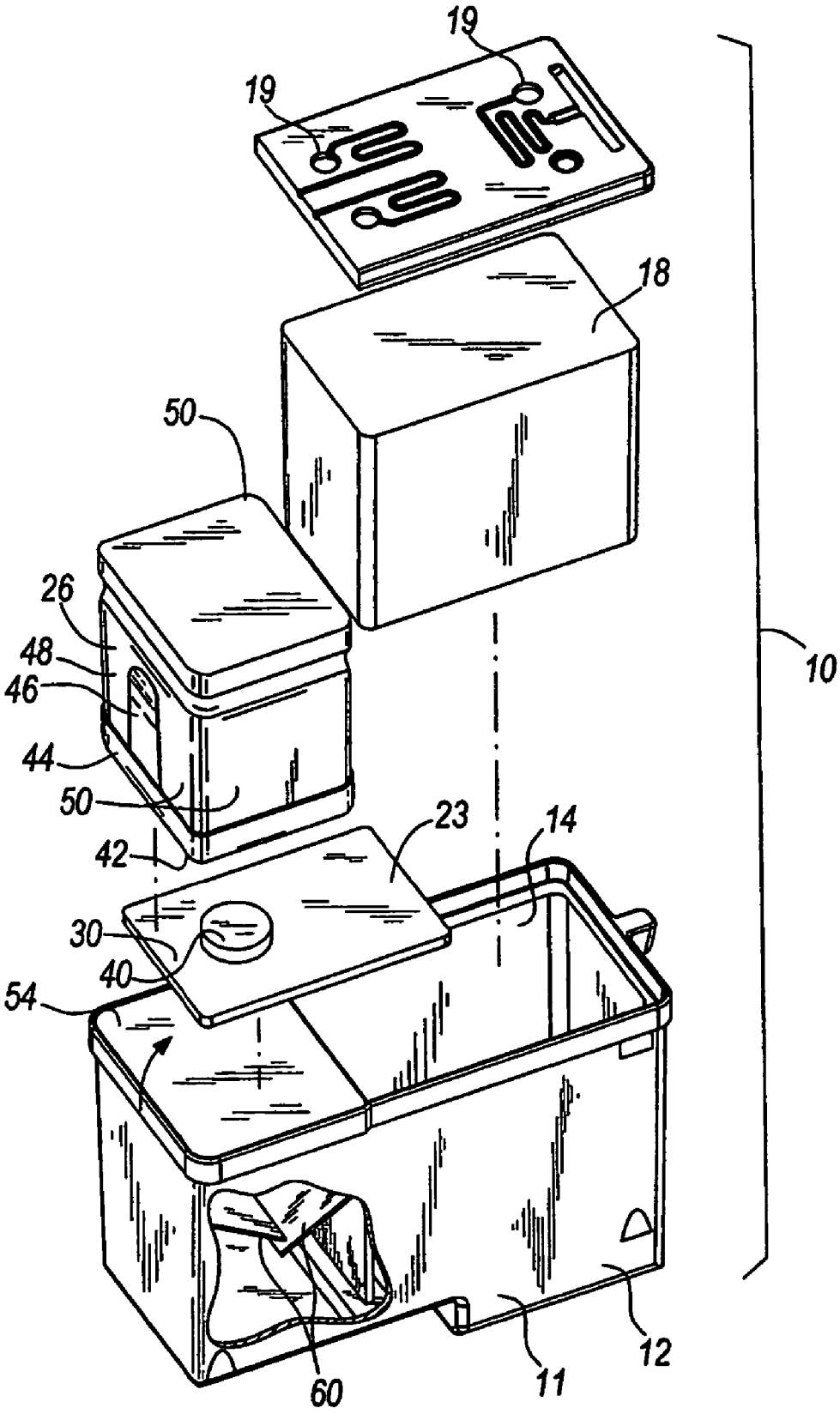
FIG. 2 is an exploded perspective view of the printhead illustrated in FIG. 1, shown with a removable ink cartridge.
Figure 3:
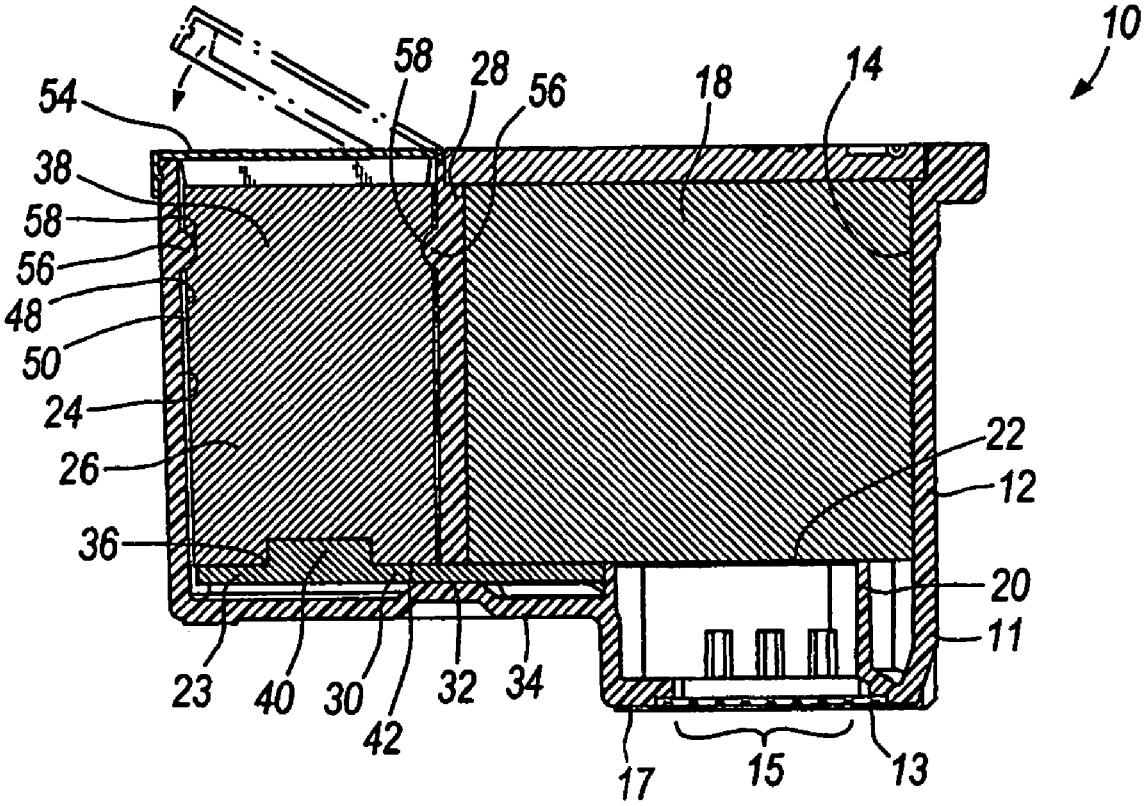
FIG. 3 is a cross-sectional side view of the printhead illustrated in FIGS. 1 and 2, taken along lines 3—3 of FIG. 1.

FIGS. 1–3 illustrate an inkjet printhead 10 according to an embodiment of the present invention. The printhead 10 includes a housing 12 that defines a nosepiece 11, an ink reservoir 14, and a receptacle 24. In other embodiments, the housing 12 can have other shapes, some of which have no identifiable nosepiece 11. The housing 12 can be constructed of a variety of materials and combinations of materials including, without limitation, polymers, metals, ceramics, composites, and the like.

The ink reservoir 14 contains a quantity of ink for controlled dispense upon a printing medium. As used herein and in the appended claims, the term "ink" can refer to at least one of inks, dyes, stains, pigments, colorants, tints, a combination thereof, and any other material that can be used by an inkjet printing apparatus to print matter upon a printing medium. As used herein and in the appended claims, the term "printing medium" can refer to at least one of paper (including without limitation stock paper, stationary, tissue paper, homemade paper, and the like), film, tape, photo paper, a combination thereof, and any other medium upon which material can be printed by an inkjet printing apparatus.

The ink reservoir 14 can define a substantially empty chamber for holding ink. Alternatively, the ink reservoir 14 can house an ink retaining medium 18 suitable for holding ink within the ink reservoir 14. For example, an ink retaining medium 18 is located within the ink reservoir 14 illustrated in FIGS. 1–3, and substantially entirely occupies the interior of the ink reservoir 14. The ink retaining medium 18 can include any material or combinations of materials capable of retaining fluid by capillary action, including without limitation artificial or natural sponge, foam, felt, and the like. The ink retaining medium 18 can occupy any portion and amount of the ink reservoir 14 desired. However, in some embodiments the ink retaining medium 18 is located to be in fluid communication with one or more elements supplying ink to the ink retaining medium 18 and/or one or more elements drawing ink from the ink retaining medium 18 as will be described in greater detail below.

The housing 12 can have one or more vent apertures 19 permitting air to be drawn into the ink reservoir 14 from outside of the housing 12 when a sufficient pressure differential exists between the interior of the ink reservoir 14 and the environment around the housing 12. Such a pressure differential can be generated when ink is drained from the ink reservoir 14 during operation of the printhead 10, thereby causing a drop in pressure within the ink reservoir 14. In some embodiments, the housing 12 can have one or more vent apertures 19 to relieve this pressure, which could otherwise interfere with ink flow from the ink reservoir 14. In some embodiments, vents having a serpentine path are provided, such that compression of air is substantially reduced and/or prevented during installation of an ink cartridge 26.

In some embodiments, the printhead 10 has one or more chips 13 (see FIG. 3) adapted to dispense ink from the printhead 10 in a controlled manner as is well known to those in the art. The chip(s) 13 can be located on a nosepiece 11 or in any other location on the printhead 10, and can cover one or more outer surfaces of the housing 12. The printhead 10 illustrated in FIGS. 1–3 has a single chip 13 covering an outer surface 17 of the nosepiece 11. As used herein, the term "chip" can refer to one or more layers of material having one or more arrays of nozzles 15, transducers (not shown), and/or firing chambers (also not shown), at least one of the one or more layers being in fluid communication with the ink reservoir 14. In other embodiments, nozzles 15 defining outlets of the printhead 10 can be located in other elements of the printhead 10. In embodiments in which the printhead 10 has more than one ink reservoir 14 (described in greater detail below), the chip 13 can be coupled to the printhead 10 such that each of the ink reservoirs 14 is in fluid communication with a respective set of transducers, firing chambers, and/or nozzles in the chip 13.

In some embodiments, ink is directed along a path from the ink reservoir 14 toward the outer surface 17 (and the chip 13, when the chip 13 is coupled to the outer surface 17), such that the ink enters one or more firing chambers, and is eventually fired from corresponding nozzles 15. Also, in some embodiments, ink located in a firing chamber can be, for example, heated and vaporized by signaling a corresponding transducer to heat up the ink in the firing chamber. The ink can then be expelled outwardly from the printhead 10 through a corresponding nozzle 15 toward a printing medium. Still other manners of expelling ink from the printhead 10 are possible, and fall within the spirit and scope of the present invention. The chip 13 can be in electrical communication with a printer controller that controls when various nozzles 15 of the chip 13 fire ink toward a printing medium.

The housing 12 illustrated in FIGS. 1–3 has a filter tower 20 (see FIG. 3) located in a bottom portion of the ink reservoir 14. The filter tower 20 is located along an ink flow path from the ink reservoir 14 toward the nozzles 15, and can at least partially define a passage through which ink flows toward the nozzles 15.

Although the filter tower 20 can extend from a bottom portion of the ink reservoir 14 as described above, the filter tower 20 can instead extend from any other portion of the ink reservoir 14 in which ink passes toward the nozzles 15 of the printhead 10 (e.g., through a side wall of the ink reservoir 14 in cases where the nozzles 15 are located on the side of the housing 12). The filter tower 20 shown in FIG. 3 has a generally rectangular shape, although filter towers 20 having any other shape can be used as desired. In this regard, the filter tower 20 can be sized and shaped to allow the proper ink flow from the ink reservoir 14 toward the nozzles 15.

The printhead 10 illustrated in FIGS. 1–3 also has a filter 22 coupled to the filter tower 20. The filter 22 can be coupled to the filter tower 20 in any of a variety of manners known in the art (e.g., laser welding, adhesive or cohesive bonding material, heat staking, etc.). A variety of types of filters 22 can be used. For example, the filter 22 in the embodiment of FIGS. 1–3 is a woven filter with a relatively fine mesh size. In other embodiments, no filter 22 is used. The filter tower 20 is positioned such that the filter 22 contacts the ink retaining medium 18 in the ink reservoir 14, or is otherwise located in the path of ink flow toward the nozzles 15 in those embodiments not having an ink retaining medium 18.

In some embodiments of the present invention, the ink reservoir 14 is at least partially filled with a supply of ink to be dispensed during printing operations, and can be replenished with ink from another ink supply. For this purpose, the receptacle 24 of the printhead 10 is in fluid communication with the ink reservoir 14. An ink cartridge 26 can be inserted within the receptacle 24 to provide a supply of ink to the ink reservoir 14. In the illustrated embodiment of FIGS. 1–3, the receptacle 24 is separated from the ink reservoir 14 by a wall 28 (see FIG. 3). However, the ink reservoir 14 is not completely separated from the receptacle 24. Instead, a wick 30 extends between the receptacle 24 and the ink reservoir 14, thereby establishing a path for ink to travel from the receptacle 24 to the ink reservoir 14. For this purpose, the wick 30 can comprise a material suitable for movement of ink along the wick 30 from the receptacle 24 to the ink reservoir 14. In some embodiments, this movement of ink is by capillary action. Accordingly, the wick 30 can comprise artificial or natural sponge, foam, felt, and the like.

In other embodiments, the wick 30 provides any other type of ink flow path from the receptacle 24 to the ink reservoir 14 (in addition to or instead of capillary action). In such cases, the wick 30 can comprise a material having less resistance to free ink movement.

The wick 30 can extend through an aperture between the wall 28 and another wall of the housing 12 (e.g., an aperture 32 between the wall 28 and a bottom wall 34 of the housing 12 as best shown in FIG. 3, or between the wall 28 and any other wall of the printhead 10), through an aperture in the wall 28, through an aperture defined by more than one wall separating the ink reservoir 14 and the receptacle 24, and the like. In some embodiments, the ink reservoir 14 and the receptacle 24 are substantially completely separated from one another with the exception of the aperture 32 through which the wick 30 extends.

The aperture 32 in the printhead of FIGS. 1–3 is an elongated gap between the wall 28 and the bottom wall 34 of the housing 12 (i.e., elongated into and out of the plane of FIG. 3). However, the aperture 32 can be in any other location in which ink can flow from the receptacle 24 to the ink reservoir 14 via the wick 30. The wick 30 can extend through an aperture 32 located at a higher elevation than the bottom of the receptacle 24 and/or the bottom of the ink reservoir 14. For example, the aperture 32 can be located anywhere between the bottom and top of the receptacle 24 and ink reservoir 14. The location of the aperture 32 through which the wick 30 extends can depend at least in part upon the shape of the housing 12 and the relative positions of the receptacle 24 and ink reservoir 14. For example, in those cases in which the bottom of the ink reservoir 14 is located at a different elevation than the bottom of the receptacle 24, the aperture 32 can be located at a higher elevation than the bottom of the ink reservoir 14 and/or the bottom of the receptacle 24. In some embodiments, a lower location of the aperture 32 in the receptacle 24 (such as that shown in the embodiment of FIGS. 1–3) can encourage more complete drainage of ink from the receptacle 24.

In the illustrated embodiment of FIGS. 1–3, the aperture 32 is an elongated gap as described above. An elongated aperture 32 can instead be located entirely within the wall 28, between the wall 28 and a sidewall of the housing 12, or in any other location in which fluid communication is established between the receptacle 24 and the ink reservoir 14. Depending at least in part upon the shape and size of the wick 30, the aperture 32 can have any shape and size desired. For example, the aperture 32 can have a substantially round, rectangular, oval, irregular, or other shape of any size through which the wick 30 can extend. The wick 30 can also have any shape and size, and in some embodiments has a cross-sectional shape corresponding to that of the aperture 32. In the illustrated embodiment of FIGS. 1–3, for example, the wick 30 is substantially flat, and has a substantially rectangular cross-sectional shape. As another example, the wick 30 can be elongated with a round cross sectional shape (e.g., a cigarette shape).

In some embodiments, one or more portions of the wick 30 have a substantially constant cross-sectional shape along its length extending between the ink reservoir 14 and the receptacle 24. For example, a body 23 of the wick 30 illustrated in FIGS. 2 and 3 is a strip of material having a substantially constant cross-sectional shape along its length extending between the ink reservoir 14 and the receptacle 24. However, in other embodiments the shape and/or size of the wick 30 can be different along its length, such as a wick 30 having larger cross-sectional area on either or both sides of the wall 28 and a reduced cross-sectional area at the aperture 32 (or vice versa), a wick 30 having different thicknesses on opposite sides of the wall 28, and the like. Still other wick shapes are possible, and fall within the spirit and scope of the present invention.

The wick 30 illustrated in FIGS. 2 and 3 fills the aperture 32 through which the wick 30 extends. In this manner, the ink reservoir 14 is substantially entirely enclosed within the housing 12, and has very little to no exposure to the environment external to the housing 12. In this regard, the ink reservoir 14 can have one or more housing vents 19 as described above. However, such vents 19 (if employed) can have a minimum size suitable for performing the venting function described above, and do not leave the interior of the ink reservoir 14 exposed to the environment outside of the housing 12. Accordingly, by filling the aperture 32 with the wick 30, the interior of the ink reservoir 14 is protected from exposure to the interior of the receptacle 24, which can be unoccupied by an ink cartridge 26 and therefore exposed to the exterior environment of the housing 12 in some cases. Although the wick 30 can fill the aperture 32 as just described, in some embodiments the wick 30 occupies less than the entire aperture 32.

The printhead 10 illustrated in FIGS. 1–3 has a single wick 30 extending from the receptacle 24 to the ink reservoir 14. In other embodiments, the printhead 10 has two or more wicks 30 located in different positions, each wick 30 extending from the receptacle 24 to the ink reservoir 14 for transporting ink as described above. Two or more wicks 30 can extend from the same location in the receptacle 24 and/or can extend to the same location in the ink reservoir 14 while still defining different paths of ink to the ink reservoir 14. In other embodiments, two or more wicks 30 extend from different respective locations in the receptacle 24 to different respective locations in the ink reservoir 14.

The ink cartridge 26 can have any shape and size desired, and in some embodiments has a shape and size corresponding to the shape and size of the receptacle 24. For example, the ink cartridge 26 illustrated in FIGS. 1–3 is substantially cuboid in shape, and generally corresponds in size and shape to the receptacle 24 of the printhead 10. In other embodiments, the ink cartridge 26 can instead have any cubic, cylindrical, irregular, or other shape, and need not necessarily correspond in size and shape to the receptacle 24.

With reference to FIG. 2, the ink cartridge 26 of the illustrated embodiment has a length, a width narrower than the length, and a height. Therefore, the ink cartridge 26 can be inserted in only two orientations. In some embodiments, one or more features of the ink cartridge 26 and/or the receptacle 24 can be used to require insertion of the ink cartridge 26 in a single orientation with respect to the receptacle 24. By employing one or more such features, the resulting "keyed" design of the ink cartridge 26 can insure that the ink cartridge 26 is installed properly within the receptacle 24 (e.g., in cases where such an orientation is required to properly position an outlet 36 of the ink cartridge 26 with respect to the wick 30). For example, a wall of the receptacle 24 can have a rib, bump, wall, or other protrusion (not shown) extending into the receptacle 24 and positioned to mate with a groove, slot, hole, or other aperture of the ink cartridge 26 when the ink cartridge 26 is properly oriented and inserted in the receptacle 24. The protrusion can prevent insertion of the ink cartridge 26 when insertion of the ink cartridge 26 is attempted in any other orientation. Alternatively, the protrusion can be located on the ink cartridge 26 for mating with an aperture of the receptacle 24. As another example, a corner of the receptacle 24 can be at least partially filled to match a chamfered corner of the ink cartridge 26, thereby requiring insertion of the ink cartridge 26 in a single orientation. As yet another example, the ink cartridge 26 can have a shape (e.g., trapezoidal, T or L-shaped, and the like) corresponding to the receptacle 26 and permitting cartridge insertion only in one cartridge orientation. It will also be appreciated that a keyed cartridge design can be employed to enable cartridge insertion in more than one orientation with respect to the receptacle 26, but still in less than all possible orientations.

The ink cartridge 26 illustrated in FIGS. 1–3 occupies approximately one third of the volume of the printhead 10, although the ink cartridge 26 occupies less or more than this volume in other embodiments.

The ink cartridge 26 illustrated in FIGS. 1–3 has a housing 48 within which a supply of ink is retained. In some embodiments, the housing 48 comprises a number of substantially rigid walls 50, one or more of which can define an exterior wall of the printhead 10 when the ink cartridge 26 is installed within the printhead 10. The housing 48 can also include a tab, flange, handle, or other user-manipulatable portion (not shown) enabling a user to grasp the ink cartridge 26 during cartridge insertion and removal operations. The user-manipulatable portion can have any shape suitable for this purpose.

With continued reference to FIGS. 1–3, the ink cartridge 26 has an outlet 36 through which ink flows from the ink cartridge 26. When the ink cartridge 26 is fully installed within the receptacle 24, ink within the ink cartridge 26 is brought into fluid communication with the wick 30, thereby permitting ink to flow from the ink cartridge 26, along the wick 30, and into the ink reservoir 14. As will be described in greater detail below, this fluid communication can be established in a number of different manners depending at least partially upon the manner in which ink is retained in the ink cartridge 26, the type of cartridge outlet 36, and the type of interface between the wick 30 and the outlet 36.

Ink can be retained in a substantially empty chamber within the ink cartridge 26, or can be held in an ink retaining medium 38 within the ink cartridge 26. In either case, ink can be prevented from dripping from the outlet 36 in a number of conventional manners. For example, an ink retaining medium 38 can be selected that prevents such dripping and/or enables ink flow from the outlet 36 only when the ink retaining medium 38 is in contact with another element (e.g., a portion of the wick 30 as described below). As another example, a cartridge outlet 36 can be employed that is shaped to permit ink flow only when coupled with another element (e.g., using a seal pierced by a portion of printhead 10 when the ink cartridge 26 is inserted within the receptacle 24), and the like.

In some embodiments, fluid communication between the wick 30 and ink within the ink cartridge 26 is established by insertion of a part of the wick 30 into the cartridge outlet 36. For example, the wick 30 illustrated in FIGS. 2 and 3 has a protrusion 40 that extends into the cartridge outlet 36 when the ink cartridge 26 is fully installed in the receptacle 24. In this manner, the protrusion 40 contacts the ink retaining medium 38 within the ink cartridge 26, thereby establishing a path of ink flow from the ink retaining medium 38 out of the cartridge outlet 36. In other embodiments, the protrusion 40 does not extend into the cartridge outlet 36 to establish fluid flow from the ink cartridge 26. For example, the protrusion 40 can contact an ink retaining medium 38 that extends from the cartridge outlet 36 or is substantially flush with an exterior of the cartridge outlet 36.

The protrusion 40 illustrated in FIGS. 2 and 3 has a substantially round cross-sectional shape and a relatively low profile with respect to the body 23 of the wick 30. However, the protrusion 40 can have any other shape and size capable of performing the same fluid flow functions described above. Also, in other embodiments the wick 30 has multiple protrusions 40, each of which can establish fluid flow from the ink cartridge 26 through a common cartridge outlet 36 or through respective cartridge outlets 36.

As best shown in FIG. 3, the protrusion 40 of the wick 30 can have a shape and size corresponding to the shape and size of the cartridge outlet 36. In this manner, the amount of surface area of the ink retaining medium 38 exposed to the environment outside of the cartridge 36 is limited substantially to those surfaces through which ink flows. This limitation can help to prevent ink evaporation from the ink cartridge 26, and can protect the ink retaining medium 38 from drying out. However, in other embodiments, the protrusion 40 of the wick 30 can be any shape and size relative to the cartridge outlet 36.

Although the wick 30 illustrated in FIGS. 2 and 3 has a protrusion 40 positioned to extend into the cartridge outlet 36 to establish fluid flow from the ink cartridge 26, in other embodiments the wick 30 need not necessarily have a protrusion 40 to perform this function. For example, an external surface of the ink retaining medium 38 can be flush with or extend from the cartridge outlet 36, and can therefore contact a number of different wick surfaces, including wick surfaces that are substantially flush with surrounding portions of the wick 30, and wick surfaces that are recessed with respect to surrounding portions of the wick 30 (e.g., a recess in the wick 30 shaped and sized to receive a protrusion of the ink retaining medium 38). Accordingly, the wick 30 can have any other shape capable of cooperating with the ink cartridge 26 to define an interface through which ink flows from the ink cartridge 26 to the wick 30. Any number of such interfaces can exist, each of which can be defined by a protrusion 40 of the wick 30 extending into an outlet 36 of the ink cartridge 26, a recess of the wick 30 into which a protrusion of the ink cartridge 26 extends, or substantially flat portions of the wick 30 and the ink cartridge 26.

In the illustrated embodiment of FIGS. 1–3, the wick 30 is in direct contact with the ink retaining medium 38 of the ink cartridge 26 when the ink cartridge 26 is fully installed in the printhead 10. This contact places the ink retaining medium 38 (and ink therein) in fluid communication with the wick 30, thereby enabling ink to flow by capillary action from the ink retaining medium 38 to and along the wick 30. In other embodiments, the wick 30 does not directly contact the ink retaining medium 38. Instead, ink flows through one or more intermediate elements as it flows to the wick 30. Such intermediate elements can include a filter, a piece of high-capillary material, a tube, and the like. In those embodiments in which the ink cartridge 26 has no ink retaining medium 38, ink from the ink cartridge 26 can contact, be absorbed into, and flow through the wick 30 or one or more intermediate elements in contact with the wick 30 as just described.

In those embodiments in which the ink cartridge 26 has an ink retaining medium 38, the ink retaining medium 38 can occupy any portion of the ink cartridge 26. For example, the ink cartridge 26 illustrated in FIGS. 2 and 3 has an ink retaining medium 38 occupying substantially the entire interior of the ink cartridge 26. As another example, the ink retaining medium 38 can occupy only a lower portion of the ink cartridge 26 or only an area adjacent the cartridge outlet 36 (e.g., in cases where the rest of the ink cartridge 26 is at least partially filled with ink not held in an ink retaining medium 38).

The outlet 36 of the ink cartridge 26 illustrated in FIGS. 1–3 is located in a bottom wall 42 of the ink cartridge 26 for establishing fluid communication with the wick 30 located at the bottom of the receptacle 24. However, it will be appreciated that the outlet 36 of the ink cartridge 26 can be located in other positions on the ink cartridge 26, such as in any sidewall of the ink cartridge 26. In such cases, the wick 30 can be positioned in different manners to extend from the outlet 36 of the ink cartridge 26 (when the ink cartridge 26 is fully installed in the receptacle 24) to the ink reservoir 14. For example, the wick 30 can extend from a side of the ink cartridge 26 to the ink reservoir 14 in those embodiments in which the cartridge outlet 36 is located in a sidewall of the ink cartridge 26, such as by having a wick that is folded to a wall of the ink reservoir 14 and/or receptacle 24.

In some embodiments, the ink cartridge 26 can have two or more outlets 36 for passage of ink from the ink cartridge 26. The outlets 36 can take any of the forms described above, can be located in any portion of the ink cartridge 26, and can be located in a common wall or in different walls of the ink cartridge 26.

Prior to installation within the printhead 10, the outlet(s) 36 of the ink cartridge 26 can be covered by one or more covers 44 preventing evaporation or dripping of ink from the ink cartridge 26. The cover 44 can be made of plastic, metal foil, or any other material preventing ink evaporation and dripping, and can have any shape and size capable of performing these functions. Also, the cover 44 can have a pull tab 46 or other portion that can be grasped or otherwise manipulated by a user for removal of the cover 44. To install the ink cartridge 26 in the illustrated embodiment of FIGS. 1–3, a user grasps and pulls the pull tab 46, thereby removing the cover 44 capping the bottom of the ink cartridge 26 to expose the cartridge outlet 36. In other embodiments, the cover 44 is a substantially flat piece of material such as a removable tape or film covering the cartridge outlet 36, is a plug at least partially received within the cartridge outlet 36, is a lid or door that can be rotated, slid, or otherwise moved away from a position covering the cartridge outlet 36, and the like. Once the cover 44 (if employed) is removed or moved to expose the cartridge outlet 36, the ink cartridge 26 can be installed within the receptacle 24, thereby establishing fluid communication between fluid within the ink cartridge 26 and the wick 30 as described above.

In many cases, a cartridge-to-wick interface providing reliable fluid communication from the ink cartridge 26 to the wick 30 is promoted by exerting a pressure from the ink cartridge 26 upon the wick 30. For example, the cartridge ink retaining medium 38 (if used) can be pressed against the wick 30 by exerting a pressure upon the ink cartridge 26. This pressure can be generated in a number of different manners. Two such manners are illustrated in the embodiment of FIGS. 1–3: a snap-fit engagement between the ink cartridge 26 and the receptacle 24, and by pressure from a lid 54 closed upon the ink cartridge 26.

As best shown in FIG. 3, the receptacle 24 of the housing 12 has two protrusions 56 received within apertures 58 in the walls 50 of the ink cartridge 26 when the ink cartridge 26 is fully installed in the receptacle 24. The protrusions 56 of the receptacle 24 and the apertures 58 of the ink cartridge walls 50 are engaged by snap-fits, and in some embodiments can be the same features used to at least partially define the keyed cartridge-to-receptacle engagement described above. These snap-fits generate pressure of the ink cartridge 26 against the wick 30, thereby providing an improved interface between the ink cartridge 26 and the wick 30. In other embodiments, this pressure can be generated by other types of snap-fit engagements, such as by one or more protrusions of the ink cartridge 26 in snap-fit engagement with one or more apertures of the receptacle 24. Regardless of their location, the protrusions 56 can be one or more ribs, bumps, pins, bosses, and the like, and the apertures 58 can be one or more recesses, grooves, holes, dimples, and the like. Still other types of snap-fit features and snap-fit engagements capable of exerting cartridge pressure (described above) are possible and fall within the spirit and scope of the present invention.

As mentioned above, the printhead 10 illustrated in FIGS. 1–3 also has a lid 54 that can be closed upon the ink cartridge 26 and that can be opened for removal and insertion of the ink cartridge 26. In the closed position of the lid 54, the ink cartridge 26 can be substantially entirely enclosed within the housing 12, thereby reducing or substantially eliminating exposure of the ink cartridge 26 to the environment around the printhead 10.

The lid 54 can be positioned and shaped to exert a pressure against the ink cartridge 26 when the lid 54 is closed. For this purpose, the height of the ink cartridge 26 can be sufficiently large to be pressed by the lid 54 when the lid 54 is closed, thereby pressing the ink cartridge 26 against the wick 30. Alternatively or in addition, the lid 54 can be shaped to exert such a pressure against the ink cartridge 26 when the lid 54 is closed (e.g., can have one or more portions extending toward and exerting pressure upon the ink cartridge 26 when the lid 54 is closed). The lid 54 can be secured in a closed position in any manner, such as by snap-fit engagement of the lid 54 with the housing 12, by a latch, clip, or other fastener, and the like, all of which can be sufficiently strong to retain the lid 54 in the closed position while the lid 54 exerts a biasing force upon the ink cartridge 26 as described above. Although the lid 54 can be used to exert pressure upon the ink cartridge 26, the lid 54 need not necessarily perform this function.

To reduce exposure of the wick 30 to the environment surrounding the printhead 10, the printhead 10 can have one or more doors 60 movable to at least partially close part or all of the receptacle 24 when the ink cartridge 26 is removed from the receptacle 24. For example, the printhead 10 illustrated in FIGS. 1–3 has two doors 60 located within the receptacle 24 and movable between open and closed positions to open and close a portion of the receptacle 24, respectively. The doors 60 can be located in any position(s) in the receptacle in which the doors 60 can perform this function. In the illustrated embodiment of FIGS. 1–3, for example, the doors 60 are located approximately at a midpoint along the height of the receptacle 24, and therefore can be moved to close the lower half of the receptacle 24 when the ink cartridge 26 is removed. In other embodiments, the doors 60 can be located at a larger or smaller distance from the wick 30.

The printhead 10 illustrated in FIGS. 1–3 has two doors 60 extending from opposite walls of the receptacle 24. In other embodiments, a single door 60 can span the distance between walls of the receptacle 24 in order to close at least part of the receptacle 24, or three or more doors 60 can extend from any combination of receptacle walls and can cooperate to perform this function. Although the doors 60 illustrated in the embodiment of FIGS. 1–3 are substantially flat and rectangular, it will be appreciated that the doors 60 can instead have any other shape capable of performing the receptacle closing function described above, and can depend at least in part upon the shape of the receptacle 24.

In some embodiments, the door(s) 60 are biased toward their closed positions, thereby automatically closing at least part of the receptacle 24 when an ink cartridge 26 is not installed therein. The doors 60 can comprise resilient flexible material that automatically returns to its original shape after being deformed. Such material can include Mylar® (E. I. du Pont de Nemours and Company) and other resilient synthetic materials, rubber, spring steel and other spring materials, and the like. Alternatively or in addition, the doors 60 can be biased toward their closed positions by one or more springs, elastic bands, magnets, or other biasing elements, and can be pivotably coupled to the walls of the receptacle 24 in any suitable manner.

The doors 60 in the illustrated embodiments of FIGS. 1–3 are heat staked to the walls of the receptacle 24, but can be instead be attached to the walls of the receptacle 24 by adhesive or cohesive bonding material, by screws, bolts, pins, clips, clamps, or other fasteners, by inter-engaging elements on the doors 60 and/or receptacle walls, or in any other manner.

In operation, a user opens the lid 54 (if used) in preparation to install an ink cartridge 26. If the receptacle 24 is already occupied by an ink cartridge 26, the user first removes the ink cartridge 26 from the receptacle 24. The user can prepare a new ink cartridge 26 for installation by removing the cover 44 of the ink cartridge 26 (e.g., by pulling on the pull tab 46 of the cover 44), thereby exposing the cartridge outlet 36. To install the new ink cartridge 26, the user can place the ink cartridge 26 in an orientation in which the new ink cartridge 26 fits the receptacle 24 (e.g., in a single one of several orientations in some keyed ink cartridge embodiments). The ink cartridge 26 can then be inserted into the receptacle 24 through the receptacle doors 60 (if employed) until the outlet 36 of the ink cartridge 26 is brought into fluid communication with the wick 30 as described above. The ink cartridge 26 can be biased toward the wick 30 by one or more snap fits between the ink cartridge 26 and the receptacle 24 and/or by pressure exerted by the lid 54 upon the ink cartridge 26 when the lid 54 is closed.

Upon establishment of fluid communication with the wick 30, ink from the ink cartridge 26 flows from the cartridge outlet 36 to the wick 30, and then along the wick 30 toward the ink reservoir 14. The path of ink along the wick 30 toward the ink reservoir 14 extends through the aperture 32 between the receptacle 24 and the ink reservoir 14 (which are otherwise substantially separated from one another by one or more walls 28 of the housing 12 as described above). The ink flows across an interface between the wick 30 and the ink retaining medium 18 in the ink reservoir 14, and saturates or further saturates at least a portion of the ink retaining medium 18 with ink. As ink is consumed during printing operations, ink flows from the ink retaining medium 18 through the filter 22 and filter tower 20 (if employed), and through the nozzles 15 of the printhead 10. If ink remains in the ink cartridge 26, ink continues to be supplied to the ink retaining medium 18 in the ink reservoir 14 as ink exits the ink reservoir 14 and is consumed. Therefore, ink is supplied to the ink reservoir 14 from a removable ink cartridge 26 with significantly reduced risk that the supply of ink to the ink retaining medium 18 will be interrupted by ink evaporation or otherwise as a result of the environment around the printhead 10.

It should be noted that the printheads 10 and ink cartridges 26 described and illustrated herein can have any orientation. The printheads 10, printhead components, ink cartridges 26, and ink cartridge components are occasionally identified herein and in the appended claims by reference to one or more orientations. Such orientations are referenced only to describe relative positions and orientations of features and elements of the printheads 10, printhead components, ink cartridges 26, and ink cartridge components, rather than to indicate or imply that any particular orientation is required.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A printhead adapted to receive a removable ink cartridge, the printhead comprising:

a receptacle dimensioned to receive the removable ink cartridge;

a reservoir separated from the receptacle by a barrier;

an ink retaining medium in the reservoir; and a wick extending from the receptacle to the reservoir, wherein the wick is positioned to be operatively coupled to the removable ink cartridge when the removable ink cartridge is installed in the receptacle, and is operatively coupled to the ink retaining medium in the reservoir.

2. The printhead as claimed in claim 1, further comprising an outlet through which ink exits the reservoir, wherein the ink retaining medium is located in a fluid path of ink extending from the wick to the outlet.

3. The printhead as claimed in claim 2, wherein the wick is positioned to contact an outlet of the removable ink cartridge when the removable ink cartridge is installed in the receptacle.

4. The printhead as claimed in claim 1, wherein the wick includes a protrusion that extends into an outlet of the removable ink cartridge when the removable ink cartridge is installed in the receptacle.

5. The printhead as claimed in claim 1, wherein the wick is folded to a wall in the receptacle.

6. The printhead as claimed in claim 1, wherein the barrier is a wall located between the receptacle and the reservoir.

7. The printhead as claimed in claim 6, wherein the wick extends from one side of the wall to an opposite side of the wall.

8. The printhead as claimed in claim 1, wherein the ink retaining medium comprises felt.

9. The printhead as claimed in claim 1, wherein the wick transports ink via capillary flow to the ink retaining medium.

10. The printhead as claimed in claim 1, wherein:

the receptacle and the reservoir each have a bottom and a top, respectively; and the wick is an elongated piece of material extending from the bottom of the receptacle to the bottom of the reservoir.

11. The printhead as claimed in claim 1, further comprising an ink flow path through the printhead, the ink flow path extending from the receptacle to the ink retaining medium through the wick, the ink flow path further extending from the ink retaining medium to at least one outlet of the printhead.

12. The printhead as claimed in claim 11, further comprising a filter tower through which ink flows from the ink retaining medium toward the at least one outlet.

13. The printhead as claimed in claim 1, wherein the wick is permanently secured to the printhead.

14. The printhead as claimed in claim 1, further comprising a lid movable between open and closed positions to open and close the receptacle, respectively.

15. The printhead as claimed in claim 14, wherein the lid compresses the removable ink cartridge against the wick in the closed position of the lid.

16. The printhead as claimed in claim 1, wherein the receptacle is shaped to releasably engage the removable ink cartridge via at least one snap-fit connection.

17. The printhead as claimed in claim 16, wherein the at least one snap-fit connection presses the removable ink cartridge toward the wick.

18. The printhead as claimed in claim 1, wherein:

the ink retaining medium is substantially entirely enclosed within the reservoir of the printhead; and a portion of the wick is positioned to be exposed to an inside of the receptacle when the ink cartridge is removed from the receptacle.

19. The printhead as claimed in claim 1, further comprising at least one door movable to and from a closed position in which the at least one door substantially closes at least a portion of the receptacle in which the wick is located.

20. The printhead as claimed in claim 19, wherein the at least one door is biased to close when the ink cartridge is removed from the receptacle.

21. An ink cartridge configured to operatively cooperate with the printhead of claim 1.

22. The ink cartridge of claim 21, wherein felt is disposed in the cartridge for retaining ink.

23. A printhead for printing with ink from a removable ink cartridge having an outlet, the printhead comprising:

a housing having a plurality of walls;

first and second chambers at least partially defined by the plurality of walls and separated by a first wall of the plurality of walls;

an ink retaining medium in the second chamber;

a nozzle plate coupled to the housing, having at least one nozzle through which ink exits the printhead, and supplied by ink from the ink retaining medium; and a wick extending from the first chamber, past the first wall, and into the second chamber, the wick adapted to carry ink via capillary action from the outlet of the removable ink cartridge in the first chamber to the ink retaining medium in the second chamber.

24. The printhead as claimed in claim 23, wherein a portion of the wick is positioned to contact the outlet of the removable ink cartridge when the removable ink cartridge is installed within the first chamber.

25. The printhead as claimed in claim 23, wherein the ink retaining medium is positioned to receive ink from the wick and to supply ink toward the nozzle.

26. The printhead as claimed in claim 23, wherein:

the first and second chambers each have a bottom; and the wick extends from the bottom of the first chamber to the bottom of the second chamber.

27. The printhead as claimed in claim 23, wherein the wick is permanently secured to the printhead.

28. The printhead as claimed in claim 23, further comprising a lid movable between open and closed positions to open and close the first chamber, respectively.

29. The printhead as claimed in claim 28, wherein the lid is positioned to compress the removable ink cartridge when the lid is in the closed position.

30. The printhead as claimed in claim 29, wherein the lid is positioned to compress the outlet of the removable ink cartridge against the wick when the lid is in the closed position.

31. The printhead as claimed in claim 23, wherein the first chamber is shaped to receive the removable ink cartridge with at least one snap-fit connection.

32. The printhead as claimed in claim 31, wherein the at least one snap-fit connection presses the removable ink cartridge toward the wick.

33. The printhead as claimed in claim 23, wherein:

the ink retaining medium is substantially entirely enclosed within the second chamber; and the ink retaining medium is in fluid communication with the first chamber only through the wick.

34. An ink cartridge configured to operatively cooperate with the printhead of claim 23.

35. The ink cartridge of claim 34, wherein felt is disposed in the cartridge for retaining ink.

36. A printhead, comprising:

a housing;

a nozzle through which ink exits the printhead;

a first chamber in the housing;

a second chamber in the housing and separated from the first chamber by a wall;

a removable ink cartridge in the first chamber, the removable ink cartridge having an outlet through which ink exits the removable ink cartridge;

an ink retaining medium in the second chamber, the ink retaining medium located in a path of ink flow from the first chamber to the nozzle; and a wick having a first portion in capillary fluid communication with the outlet of the removable ink cartridge; and a second portion in capillary fluid communication with the ink retaining medium in the second chamber;

wherein the ink retaining medium is supplied with ink from the removable ink cartridge via the wick.

37. The printhead as claimed in claim 36, wherein the wick is in contact with the outlet of the removable ink cartridge.

38. The printhead as claimed in claim 36, further comprising a lid movable between opened and closed positions to open and close the second chamber, respectively.

39. The printhead as claimed in claim 38, wherein the lid compresses the removable ink cartridge when the lid is in the closed position.

40. The printhead as claimed in claim 38, wherein the lid presses the outlet of the removable ink cartridge toward the wick when the lid is in the closed position.

41. The printhead as claimed in claim 36, wherein the removable ink cartridge is coupled within the first chamber by at least one snap-fit connection.

42. The printhead as claimed in claim 41, wherein the at least one snap-fit connection compresses the removable ink cartridge.

43. The printhead as claimed in claim 41, wherein the at least one snap-fit connection presses the outlet of the removable ink cartridge toward the wick.

44. The printhead as claimed in claim 41, wherein the first portion of the wick extends to a location where the first portion is exposed to an interior of the first chamber when the ink cartridge is removed from the printhead.

45. An ink cartridge configured to operatively cooperate with the printhead of claim 36.

46. The ink cartridge of claim 45, wherein felt is disposed in the cartridge for retaining ink.

* * * * *